United States Patent [19]

Difley et al.

[11] 3,994,216

[45] Nov. 30, 1976

[54] REFUSE COMPACTOR CONTROL

[75] Inventors: Charles Rogers Difley; William Roy McDonald, both of Danville, Ky.

[73] Assignee: Whirlpool Corporation, Benton Harbor, Mich.

[22] Filed: July 21, 1975

[21] Appl. No.: 597,405

[52] U.S. Cl. ..... 100/53; 100/229 A

[51] Int. Cl.[2] ..... B30B 15/14

[58] Field of Search ..... 100/53, 52, 99, 229 A, 100/48; 425/154, 136, 138

[56] References Cited

UNITED STATES PATENTS

| | | | |
|---|---|---|---|
| 3,527,161 | 9/1970 | Brown et al. | 100/229 A |
| 3,537,390 | 11/1970 | Hinkel | 100/53 |
| 3,543,676 | 12/1970 | Brown | 100/229 A |
| 3,613,560 | 10/1971 | Bottas et al. | 100/53 |
| 3,805,084 | 4/1974 | Schuerman et al. | 100/229 A |
| 3,807,295 | 4/1974 | Engebretsen | 100/229 A |
| 3,808,453 | 4/1974 | Engebretsen et al. | 100/52 |
| 3,845,707 | 11/1974 | Enright | 100/53 |

*Primary Examiner*—Billy J. Wilhite

*Attorney, Agent, or Firm*—Wegner, Stellman, McCord, Wiles & Wood

[57] ABSTRACT

A refuse compactor having a movable compacting receptacle with a plurality of control switches arranged in a novel manner to facilitate control of the compactor operation. The switches include switches for controlling the electrical drive motor of the compacting ram and structure for actuating the switches under different conditions, such as a tilted condition of the receptacle, a retraction of the ram to a retracted position, a displacement of the receptacle from the compacting position, and the like. The switches are disposed in juxtaposition for facilitated control and maintenance. An indicator may be provided for indicating the prevention of operation of the apparatus because of a tilted condition of the receptacle. The switch actuator structure includes a rod which is movably carried by the frame of the compactor and which includes a plurality of operating portions arranged to actuate different switches under different conditions of the compactor.

19 Claims, 7 Drawing Figures

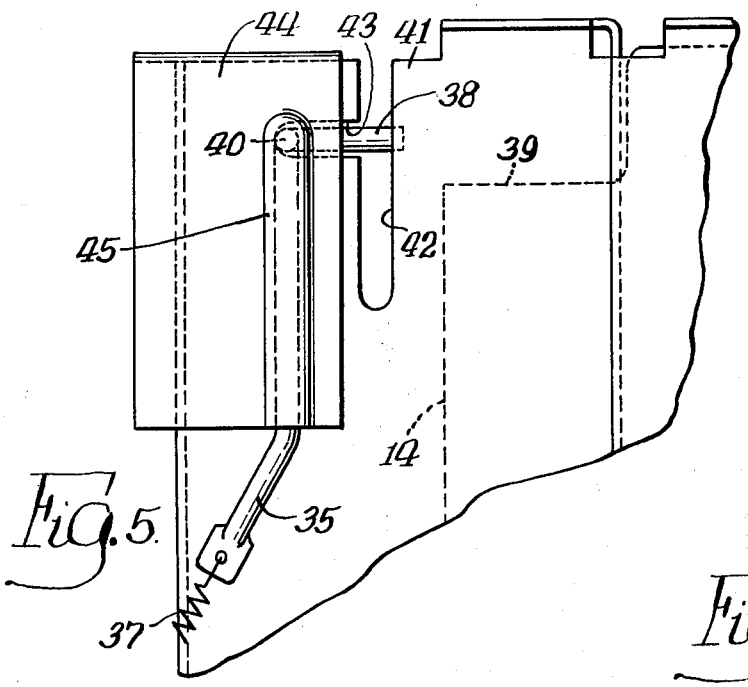
Fig. 5.
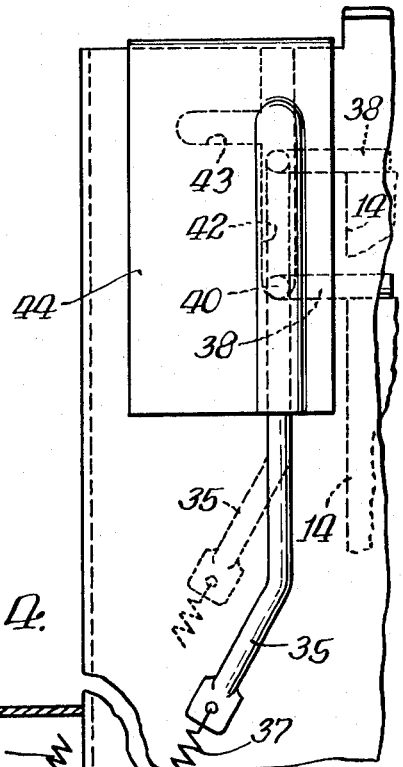
Fig. 4.
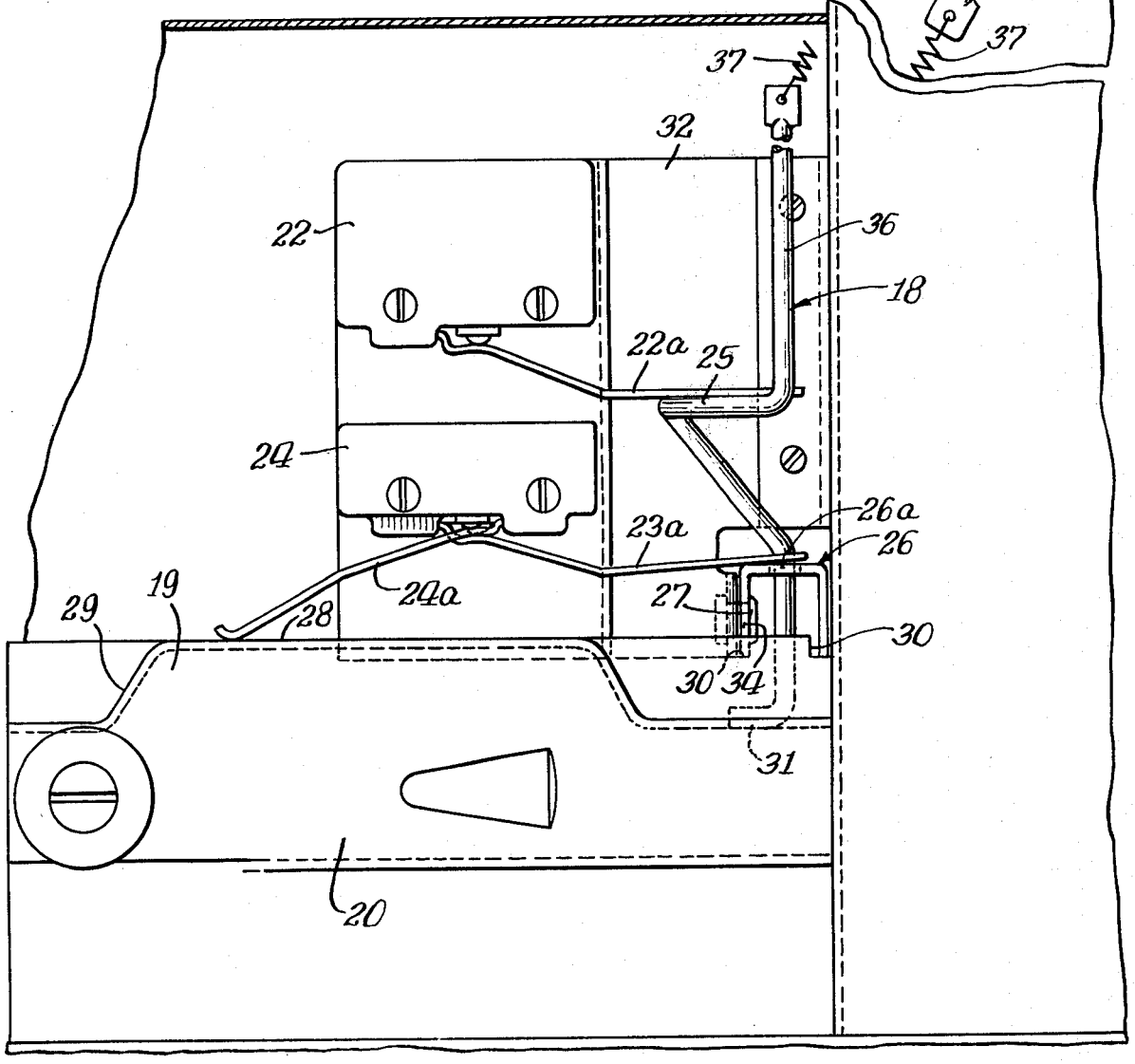

46
L1
L2
24
62
56
53
57
21
47
61
52
54
55
22
48
58
51
16
23
59
49
60
50
14
40
41
44
43
38
45
42
35
37
18

21
22
21a
22a
25
23
24
23a
24a
26a
33
29
27
26
31
20

REFUSE COMPACTOR CONTROL

BACKGROUND OF THE INVENTION

1. Field of the Invention

The present invention relates to refuse compactor structures and in particular to means for controlling the operation of refuse compactors.

2. Description of the Prior Art

As shown in U.S. Letters Pat. No. 3,613,560 of Michael J. Bottas et al, owned by the assignee hereof, one conventional form of refuse compactor utilizes a movable drawer which, when inserted into a cabinet, is disposed in a compacting position wherein a ram may be moved downwardly into the drawer to compact refuse under high pressure in the drawer. The ram is driven by an electrical motor drive and control switches are associated with the ram and drawer for controlling operation of the compactor. As disclosed in said Bottas et al patent, the control means conventionally permit operation of the ram only when the drawer is substantially in the compacting position within the cabinet. The control means further automatically terminate the compaction operation upon the compaction force reaching a preselected maximum and cause an automatic reverse movement of the ram to a retracted position outwardly of the drawer so that the drawer may be moved outwardly from the cabinet to receive additional refuse or permit removal of the compacted refuse as desired.

The control further causes an automatic reversal of the ram in the event the drawer becomes displaced during the compacting operation as by a jamming of the ram or uneven force application resulting from bottles and the like becoming jammed between the ram and the wall of the drawer.

Other prior art patents include U.S. Letters Pat. No. 2,316,734 of Mansel S. Wells, which discloses a can crusher and baler having coordinated door latching and control mechanisms requiring the closure of the access doors prior to permitting operation of the compacting cylinder.

In U.S. Letters Pat. Nos. 3,805,084 of Victor F. Schuerman, et al, 3,808,453 of Einar O. Engebretsen et al, and 3,807,295 of Einar O. Engebretsen, different control structures are illustrated for use in refuse compactors.

Another known compactor utilizes a pivoted latch member cooperating with a notch on one side of the compactor receptacle carriage to latch the receptacle closed, the latching means being independent of the control switching means therein.

SUMMARY OF THE INVENTION

The present invention comprehends an improved refuse compactor structure wherein the control switch means of the compactor are juxtaposed to be actuated by an improved operator rod means. In the illustrated embodiment, the switches are juxtaposed adjacent the track means for movably supporting the drawer. The improved arrangement of the control switches provides facilitated maintenance and simplicity and economy of construction while yet assuring positive trouble-free control of the refuse compactor.

The invention further comprehends the utilization of a single switch for controlling the operation of the ram both as a function of the tilting of the drawer and as a function of the ram reaching the retracted position at the completion of a compaction operation.

The operator rod may further define means for controlling latching of the drawer in the compacting position.

An indicator may be provided for indicating the stoppage of the compacting operation as the result of a tilting of the drawer, permitting the user to retract the ram by manual operation of the Start button of the control.

The latching means of the present invention is arranged to accommodate a small amount of movement of the drawer as may occur in normal compacting operations while yet preventing movement of the drawer sufficiently to cause termination of the compacting operation by the drawer position sensing switch provided for assuring that the drawer is in the compacting position prior to the initiation of the compacting operation.

In the present invention, the operating rod is carried by the compactor frame with the ram engaging a portion of the rod to effect the desired control of the switch means in the operation of the apparatus.

BRIEF DESCRIPTION OF THE DRAWING

Other features and advantages of the invention will be apparent from the following description taken in connection with the accompanying drawing wherein:

FIG. 4 is a broken side elevation of the control means;

FIG. 5 is a fragmentary side elevation of the upper portion of the control in an inoperative disposition such as for use in removing the ram from the compactor;

DESCRIPTION OF THE PREFERRED EMBODIMENT

Figure 1:
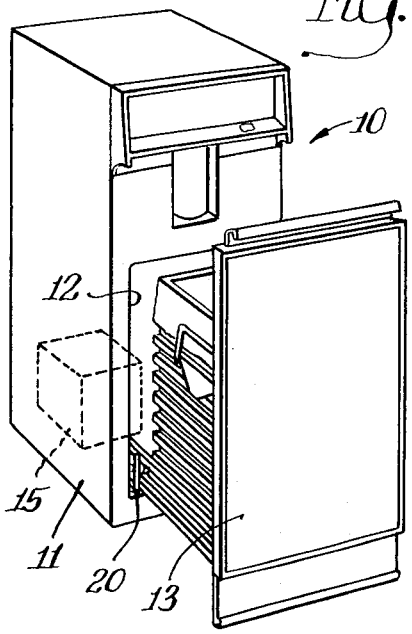
FIG. 1 is a perspective view of a refuse compactor having control means embodying the invention.
Figure 2:
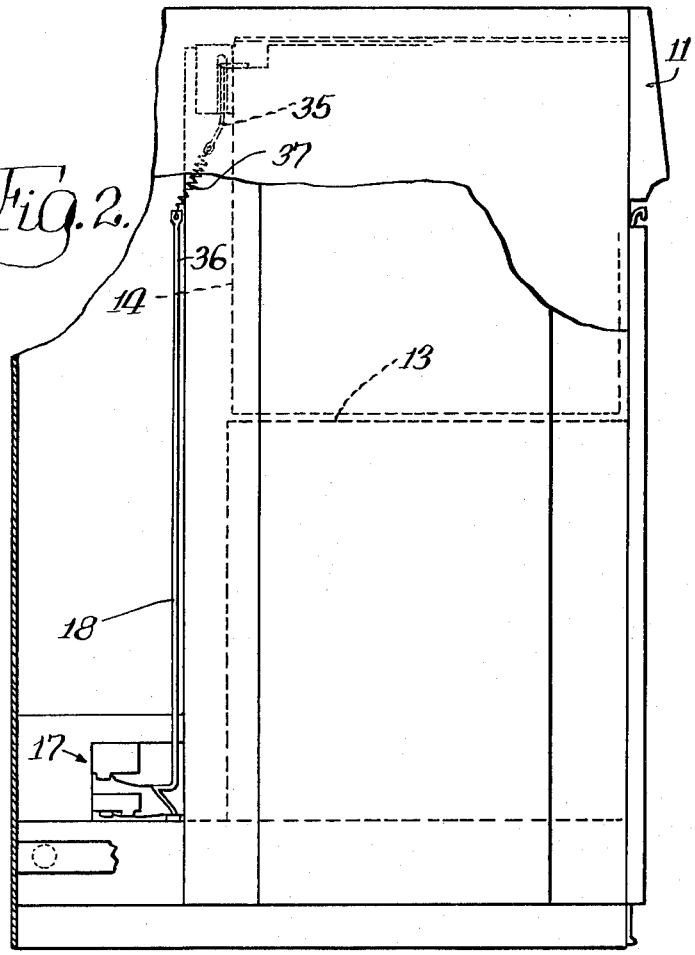
FIG. 2 is a fragmentary side elevation with portions broken away for facilitated illustration of the control means provided therein.

In the exemplary embodiment of the invention as disclosed in the drawing, a refuse compactor generally designated 10 is shown to comprise a cabinet 11 defining a front opening 12 through which a refuse holding receptacle, herein a drawer 13, is selectively movable between an outwardly exposed refuse receiving position, as shown in FIG. 1, and an inner, refuse compacting position, as shown in dotted lines in FIG. 2.

Refuse is compacted in drawer 13 by means of a ram 14 which is selectively moved downwardly into the drawer in the compacting position to forcibly compact refuse disposed therein and retracted to an upper retracted position, as shown in dotted lines in FIG. 2, above the drawer to permit movement of the drawer from the compacting position to the refuse receiving position of FIG. 1 for reception of additional refuse to be compacted therein. Conventional electrical drive means generally designated 15 may be provided for powering the ram and may include a reversible electric motor 16 conventionally mounted in a rear portion of cabinet 11.

As discussed briefly above, movement of the ram is controlled by suitable electrical switch means generally designated 17. The switch means, it turn, are operated herein by an operator rod generally designated 18. The present invention comprehends the juxtaposition of the control switches rearwardly of the drawer in cabinet 11 and adjacent a rear portion 19 of the track slide 20 movably carrying drawer 13.

Herein, switch means 17 comprises four switches including a reversing switch 21, a tilt light switch 22, a tilt and top limit switch 23, and a drawer switch 24. The rod 18 includes a turned operator portion 25 engaging an actuator 21*a* of switch 21 and an actuator 22*a* of switch 22. A U-shaped latch 26 is vertically pivotally mounted to the frame by a suitable pivot support 27 to be in latching relationship with the slide 20 when the rod is in the lower position of FIG. 4. The bight portion 26*a* of the latch underlies an actuator 23*a* of the tilt and top limit switch 23. The drawer switch 24 includes an actuator 24*a* which rests on the top surfaces 28 of the slide 20 which defines a depressed portion 29 at the rearward end thereof. Latch 26 prevents forward movement of the slide 20, and drawer carried thereby, so as to maintain the drawer switch actuator 24*a* in the upper position of FIG. 4 when the drawer is in the refuse compacting position. As shown in FIG. 4, the latch engages notch 30 in the slide 20 which is sufficiently large to permit some limited movement of the drawer during the compacting operation while yet preventing the movement of the drawer and slide sufficiently forwardly to allow actuator 24*a* to drop into recess 29 and thereby operate drawer switch 24 to prevent further operation of the compactor.

Figures 6, 7:
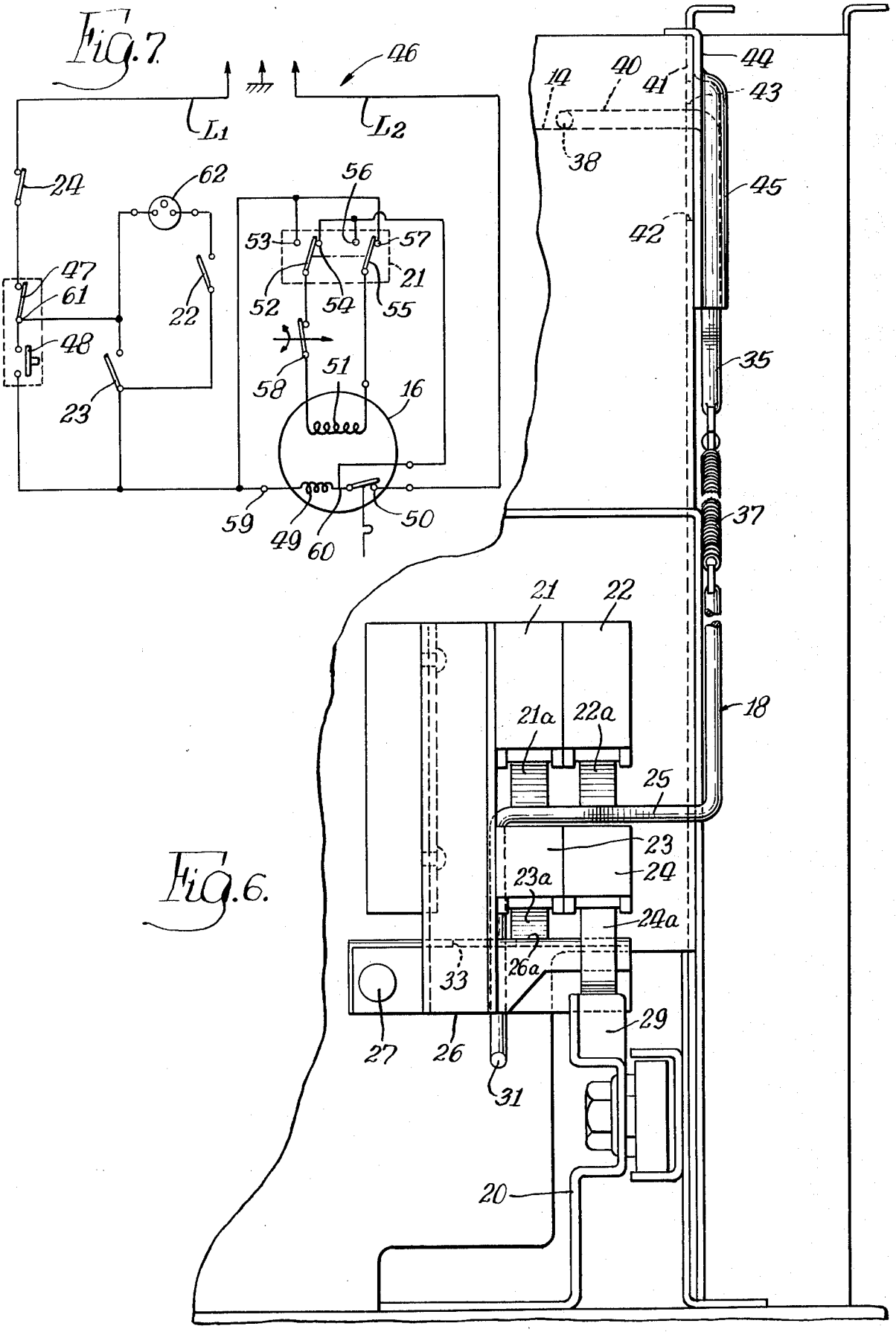
FIG. 6 is a fragmentary broken end elevation of the control means.
FIG. 7 is a schematic diagram of the electrical circuitry of the apparatus.

As best seen in FIGS. 4 and 6, operator rod 18 includes a turned end portion 31 which extends under the latch 26 to permit the latch to be disposed in latching engagement with slide 20 when the rod is in the lowermost position. When the rod is raised to lift the latch 26 from the notch 30, the latch concurrently operates the top limit switch actuator 23*a*, and rod portion 25 operates actuators 21*a* and 22*a* of switches 21 and 22.

Figure 3:
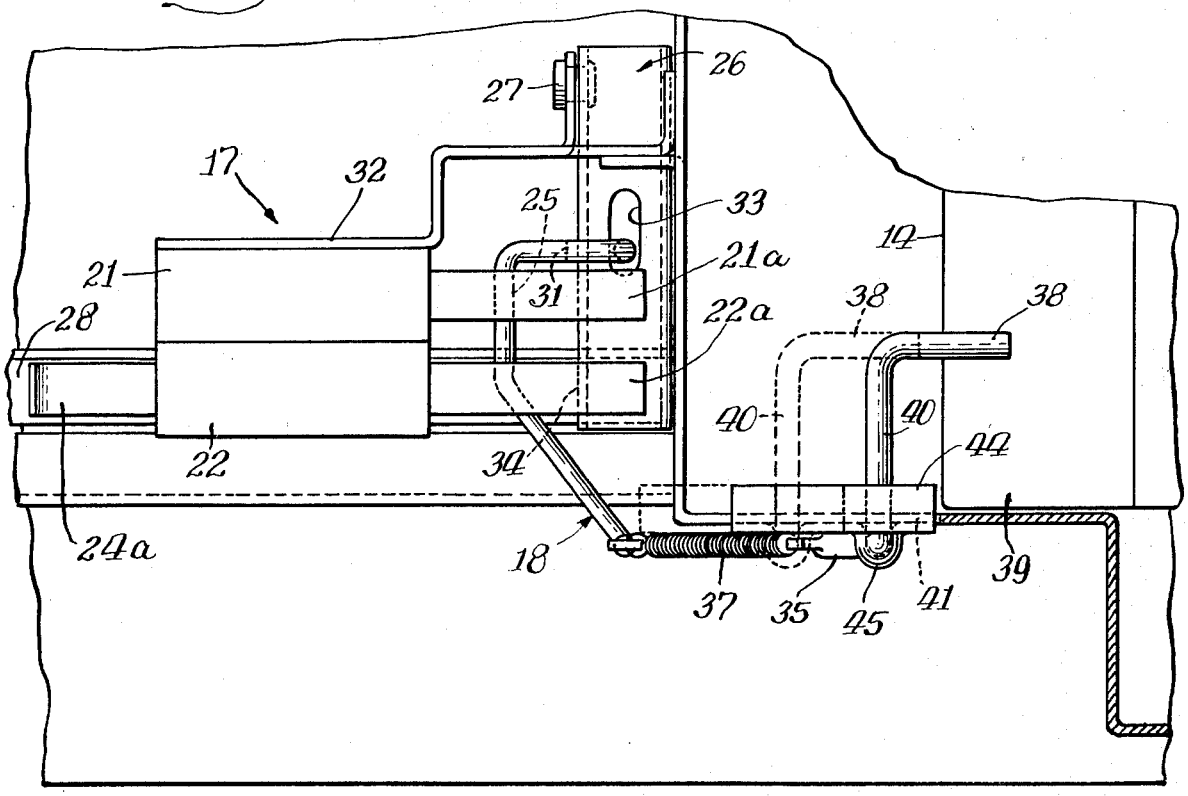
FIG. 3 is a plan view of the control means.

As shown in FIG. 3, the switches are mounted to a support portion 32 of the cabinet frame to which latch 26 is pivotally mounted by pivot support 27. The lower end of rod 18 extends downwardly through a slot 33 in the latch 26 with the end portion 31 being reversely turned to underlie the rear flange 34 of the U-shaped latch.

Operator rod 18 includes an upper portion 35 which is connected to the lower portion 36 by a suitable spring 37 to provide a resilient connection therebetween. The upper rod portion includes a turned end 38 which is adapted to be engaged by an upper surface 39 of the ram 14 when the ram reaches the upper retracted position. The upper end of rod portion 35 further includes a transverse turned portion 40 extending through upper frame portion 41 so as to be normally vertically movable in a vertical slot 42 therein to accommodate vertical movement of the rod. The frame further includes a rearwardly extending slot 43 disposed above the surface 39 when the ram is in the uppermost position to permit the rod portion 40 to be moved rearwardly to the dotted line position of FIG. 3, thereby to cause the distal portion 38 to be spaced rearwardly from the ram and thereby permit the ram to be removed upwardly from the apparatus such as in servicing the compactor. The rod portion 40 is positioned by a guide 44 having a downwardly opening channel 45 so as to urge the guide portion 40 to the dotted line retracted position of FIG. 3 (see FIG. 5) upon a rearward displacement of the guide. When the guide is moved forwardly, as shown in FIG. 4, the portion 38 will lie in the path of upward movement of ram surface 29 so as to be lifted thereby as the ram moves to the retracted position above drawer 13, as shown in FIG. 2. This upward movement of portion 38 concurrently effects upward movement of the entire rod so as to raise operating portion 25 and turned end 31 sufficiently to operate switches 21, 22, and 23 and effect desired release of the latch 26 from notch 30 to permit movement of the drawer to the refuse receiving position of FIG. 1.

In the compacting operation, the lowering of the ram into the drawer permits the rod to drop thereby lowering operating portion 25 and end 31. The sequential operation of the control may be best understood by reference to the schematic wiring diagram of FIG. 7 wherein the control generally designated 46 is connected to power supply leads L1 and L2. Power is provided through the single pole, drawer switch 24 through a single pole, Run switch 47 and a normally open single pole momentary contact pushbutton switch 48 to the run winding 49 of motor 16. Run winding 49 is connected through a motor protective overload device 50 to power supply L2. Motor 16 further includes a start winding 51 which is connected through the reversing switch 21 suitably to effect reversible starting of the motor. More specifically, switch 21 comprises a double pole, double throw switch having a first moving contact 52 selectively engaging a first fixed contact 53 and a second fixed contact 54, and a second movable contact 55 selectively engaging a third fixed contact 56 and a fourth fixed contact 57. Moving contact 52 is connected in series with a single pole motor centrifugal switch 58 connected to one end of the start winding 51, and moving contact 55 is connected to the other end of the start winding 51. Fixed contacts 53 and 57 are connected to one end 59 of the run winding 49 and contacts 54 and 56 are connected to the other end 60 of the run winding between the run winding and the overload device 50.

The connection 61 between switches 47 and 48 is connected to run winding end 59 through the tilt and top limit switch 23. A series connection of a tilt light 62 and tilt light switch 22 is connected in parallel with switch 23. In FIG. 7, control 46 is shown as arranged at the end of a cycle with the ram in a retracted position and with the drawer in the closed position so as to close switch 24 whereby the control is arranged for initiation of a compacting cycle.

The reversing switch 21 is arranged to cause the motor 16 to start in the ram lowering direction. Momentary closing of the switch 48 causes energization of the motor to start the ram downwardly into the drawer to effect the desired compaction of refuse therein. After a small downward movement of the ram releasing the rod portion 38, the rod operator portion 25 releases the reversing switch permitting it to be thrown to the lefthand position. At this time, the motor centrifugal switch 58 is open and, thus, the motor continues to run in the ram lowering direction notwithstanding the reversal of switch 21. At the same time, the initial downward movement of the ram permits switch 23 to close maintaining the circuit to the motor notwithstanding a release of the pushbutton switch 48.

As indicated above, latch 26 maintains the drawer in the compacting position within cabinet 11 so that drawer switch 24 is maintained closed during the compacting operation. However, as indicated briefly above, at times, a tilting of the drawer may occur because of uneven loading, with an asymmetric reaction force being produced by the ram compaction operation tending to tilt the drawer. Such tilting is sensed by the tilt and top limit switch 23 by the upward movement of the latch 26 against actuator 23*a* resulting from the drawer tilt thereby opening switch 23 and preventing further downward movement of the ram by motor 16.

At this time, the tilt light switch 22 is closed, having closed when the operator portion 25 of rod 18 dropped as a result of the initial downward movement of the ram. However, as long as switch 23 remained closed, light 62 is effectively shunted and remains inoperative. Upon opening of the switch 23 to stop operation of the motor, indicating light 62 becomes energized through the closed switch 22 to indicate to the user that the stoppage of the compactor was due to a tilted condition of the drawer whereupon the operator may effect a withdrawal of the ram from the compactor by simply momentarily closing the start pushbutton switch 48. As the reversing switch 21 is now in the reverse position, the start winding 51 is energized in a ram retracting direction to raise the ram from the drawer back to the retracted position of FIG. 2, permitting the operator to open the drawer and redistribute the refuse to permit subsequent proper compaction thereof upon reclosing of the drawer and reinitiation of the compacting cycle as discussed above.

Thus, the present invention comprehends an improved refuse compactor control combining the tilt and top limit switch functions in a single switch and providing improved indicating means for indicating a drawer tilting stoppage of the compactor operation. The invention further comprehends an improved arrangement of the control for facilitated maintenance as well as for improved control of the compactor operation. The operation of the control switches is effected by a single operator rod device which is further arranged to permit facilitated removal of the ram when desired.

The control means of the present invention is extremely simple and economical of construction while yet providing the highly desirable features discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a receptacle in which refuse is placed to be compacted, a ram, electrical operable drive means for selectively driving the ram into the receptacle to compress refuse therein and returning the ram to a retracted position outwardly of the receptacle, and means for movably supporting the receptacle for selective disposition in a refuse compacting position in alignment with the ram and in an exposed refuse loading position, improved control means comprising:

a switch connected for selectively energizing said drive means; and means for operating said switch to discontinue operation of the drive means whenever either (a) said receptacle is undesirably tilted as an incident of compaction of refuse in the receptacle by the ram, or (b) the ram reaches the retracted position upon completion of a refuse compacting operation.

2. The refuse compactor means of claim 1 wherein said switch operating means includes means for limiting movement of the receptacle from the refuse compacting position.

3. The refuse compactor means of claim 1 further including an indicating means, and means for operating said indicating means as an incident of said undesirable tilting of the receptacle sufficient to cause said switch to discontinue operation of the drive means.

4. The refuse compactor means of Claim 3 wherein said means for operating said indicating means comprises a second switch.

5. The refuse compactor means of Claim 3 wherein said means for operating said indicating means comprises a second switch and said switch operating means includes means for causing said second switch to prevent operation of said indicating means when said ram is in said retracted position.

6. The refuse compactor means of Claim 3 wherein said means for operating said indicating means comprises a second switch, said second switch and said indicating means are connected in series, and the series connection thereof is connected in parallel with said first named switch.

7. The refuse compactor means of claim 3 wherein said indicating means includes a control switch disposed adjacent a bottom portion of the receptacle.

8. In a refuse compactor having a receptacle in which refuse is placed to be compacted, a ram, electrical operable drive means for selectively driving the ram into the receptacle to compress refuse therein and returning the ram to a retracted position outwardly of the receptacle, and means for movably supporting the receptacle for selective disposition in a refuse compacting position in alignment with the ram and in an exposed refuse loading position, improved control means comprising:

a first switch connected for selectively energizing said drive means;

means for operating said first switch to discontinue operation of the drive means whenever either (a) said receptacle is undesirably tilted as an incident of compaction of refuse in the receptacle by the ram, or (b) the ram reaches the retracted position upon completion of a refuse compacting operation;

a second switch connected for controlling energization of said drive means; and means for causing said second switch to prevent operation of the drive means in the event said receptacle is spaced from said refuse compacting position.

9. The refuse compactor means of claim 8 further including retaining means for maintaining the receptacle in the refuse compacting position when the ram is spaced from said retracted position.

10. The refuse compactor means of claim 9 wherein said retaining means is arranged to permit a preselected limited displacement of the receptacle in the refuse compacting position.

11. The refuse compactor means of claim 9 wherein said retaining means comprises a movable element having a portion defining a portion of said switch operating means.

12. The refuse compactor means of claim 8 wherein said first and second switches are juxtaposed.

13. The refuse compactor means of claim 8 wherein said first and second switches are juxtaposed adjacent the means for movably supporting the receptacle.

14. The refuse compactor means of claim 8 further including a third, reversing switch for causing the drive means to be reconnected for reverse operation when the ram reaches the retracted position.

15. In a refuse compactor having a receptacle in which refuse is placed to be compacted, a ram, electrical operable drive means for selectively driving the ram into the receptacle to compress refuse therein and returning the ram to a retracted position outwardly of the receptacle, and means for movably supporting the receptacle for selective disposition in a refuse compacting position in alignment with the ram and in an exposed refuse loading position, improved control means comprising:

a first switch and a second switch connected for selectively energizing said drive means; and an operator having first means for operating said first switch to discontinue operation of the drive means whenever either (a) said receptacle is undesirably tilted as an incident of compaction of refuse in the receptacle by the ram, or (b) the ram reaches the retracted position upon completion of a refuse compacting operation, said operator having second means for operating said second switch to cause said drive means to be reconnected for reverse operation when the ram reaches the retracted position.

16. The refuse compactor means of claim 15 further including means for selectively retaining said receptacle in the refuse compacting position, said operator further including third means for causing said retaining means to permit movement of the receptacle from said refuse compacting position when the ram is in said retracted position.

17. The refuse compactor means of claim 15 further including indicating means, and a third switch for controlling said indicating means, said operator further including means for causing operation of said third switch to cause operation of said indicating means as an incident of said undesirable tilting of the receptacle sufficient to cause said first switch to discontinue operation of the drive means.

18. The refuse compactor means of claim 15 further including a third switch connected for controlling energization of said drive means, and means for causing said third switch to prevent operation of the drive means in the event said receptacle is spaced from said refuse compacting position.

19. The refuse compactor means of claim 15 further including means for selectively retaining said receptacle in the refuse compacting position, said operator further including third means for causing said retaining means to permit movement of the receptacle from said refuse compacting position when the ram is in said retracted position, said refuse compactor means further including indicating means, and a third switch for controlling said indicating means, said operator further including means for causing operation of said third switch to cause operation of said indicating means as an incident of said undesirable tilting of the receptacle sufficient to cause said first switch to discontinue operation of the drive means, said refuse compactor means further including a fourth switch connected for controlling energization of said drive means, and means for causing said fourth switch to prevent operation of the drive means in the event said receptacle is spaced from said refuse compacting position.

* * * * *